US005080606A

United States Patent [19]

Burkard

[11] Patent Number: 5,080,606

[45] Date of Patent: Jan. 14, 1992

[54] STACKED IN-LINE INSULATION DISPLACEMENT CONNECTOR

[75] Inventor: Christopher J. Burkard, Austin, Tex.

[73] Assignee: Minnesota Mining and Manufacturing Company, St. Paul, Minn.

[21] Appl. No.: 609,466

[22] Filed: Nov. 5, 1990

[51] Int. Cl.[5] ..... H01R 4/24

[52] U.S. Cl. ..... 439/403; 439/402

[58] Field of Search ..... 439/393, 395, 396, 402, 439/403, 404, 405, 406, 407, 417, 418, 419

[56] References Cited

U.S. PATENT DOCUMENTS

| | | | |
|---|---|---|---|
| De. 191,399 | 9/1961 | Leach | D26/1 |
| 3,012,219 | 12/1961 | Levin et al. | 339/98 |
| 3,189,863 | 6/1965 | Leach | 339/99 |
| 3,202,957 | 8/1965 | Leach | 339/98 |
| 3,258,733 | 6/1966 | Elm | 339/98 |
| 3,388,370 | 6/1968 | Elm | 339/98 |
| 3,410,950 | 11/1968 | Freudenberg | 174/84 |
| 3,500,292 | 3/1970 | Enright et al. | 339/97 |
| 3,573,713 | 4/1971 | Enright et al. | 339/98 |
| 3,576,518 | 4/1971 | Bazille, Jr. et al. | 339/98 |
| 3,605,072 | 9/1971 | Driscoll | 339/98 |
| 3,609,644 | 9/1971 | Seim | 339/98 |
| 3,656,088 | 4/1972 | Seim | 339/98 |
| 3,723,948 | 3/1973 | Wyatt | 339/99 |
| 3,793,611 | 2/1974 | Johansson et al. | 339/98 |
| 3,793,612 | 2/1974 | Driscoll | 339/98 |
| 3,804,971 | 4/1974 | Bazille, Jr. | 174/88 |
| 3,845,236 | 10/1974 | Anderson | 174/88 |
| 3,858,157 | 12/1974 | Bazille, Jr. | 339/98 |
| 3,869,190 | 3/1975 | Bazille, Jr. | 439/402 |
| 3,912,356 | 10/1975 | Johansson | 339/98 |
| 3,949,467 | 3/1976 | Mayala | 29/628 |
| 3,985,416 | 10/1976 | Dola et al. | 339/98 |
| 4,047,784 | 9/1977 | Trank | 339/98 |
| 4,124,265 | 11/1978 | Turk | 339/97 |
| 4,272,147 | 6/1981 | Berglund et al. | 439/403 |
| 4,326,767 | 4/1982 | Silbernagel et al. | 339/98 |
| 4,435,034 | 3/1984 | Aujla et al. | 339/98 |
| 4,444,447 | 4/1984 | Markwardt | 339/98 |
| 4,444,448 | 4/1984 | Silbernagel et al. | 339/98 |
| 4,444,449 | 4/1994 | Aysta et al. | 339/99 |
| 4,496,206 | 1/1985 | Markwardt et al. | 339/98 |
| 4,522,429 | 11/1985 | van Alst | 339/99 |
| 4,822,954 | 4/1989 | Rebers et al. | 174/93 |
| 4,834,668 | 5/1989 | Markwardt | 439/392 |
| 4,861,278 | 8/1989 | McBride et al. | 439/402 |
| 4,891,018 | 1/1990 | Afflerbaugh et al. | 439/402 |
| 4,952,169 | 8/1990 | Hayes, Sr. | 439/402 |
| 4,954,098 | 9/1990 | Hollingsworth et al. | 439/404 |

FOREIGN PATENT DOCUMENTS

| | | | |
|---|---|---|---|
| 2161994 | 1/1986 | United Kingdom | 439/402 |

*Primary Examiner*—Larry I. Schwartz
*Assistant Examiner*—Hien D. Vu
*Attorney, Agent, or Firm*—Gary L. Griswold; Walter N. Kirn; Jack V. Musgrove

[57] ABSTRACT

An insulation displacement connector for interconnecting a variable number of wires in a stacked, in-line configuration. The connector includes a hollow body for receiving the wires, a metallic contact element located within the body, and a cover. In the primary embodiment, the body has front and rear walls each having three holes in a stacked, nonlinear arrangement. The stacking feature provides a more compact connector. All but two of the holes are obstructed by rupturable membranes which seal unused holes and thus provide greatrer flexiblility with regard to the number of wires which may be reliably interconnected. The contact element includes shoulder contacts for receiving the upper wires, and leg contacts which extend beyond the shoulder contacts for receiving the lower wires. The cover advantageously has a plunger which forces sealant material throughout the body, and further has strain relief fingers and latching clips.

4 Claims, 2 Drawing Sheets

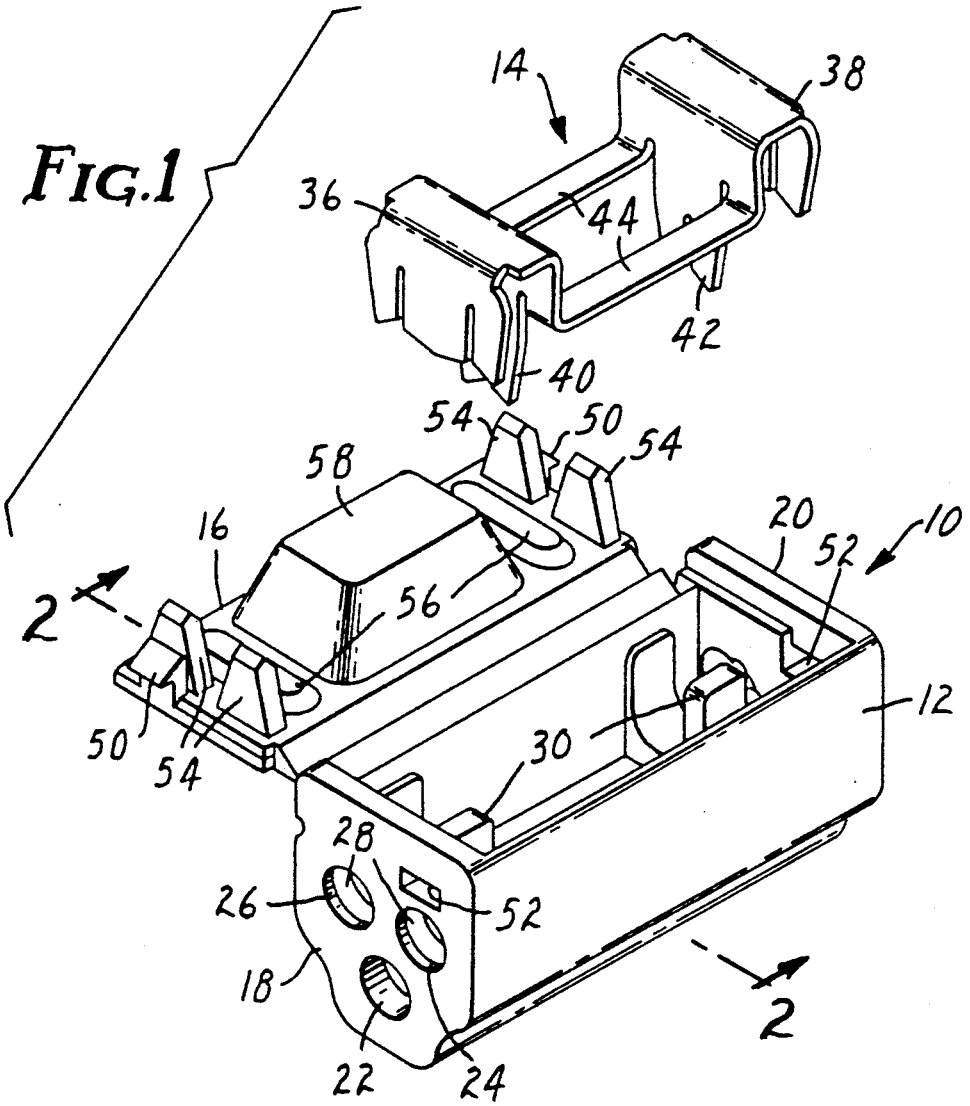
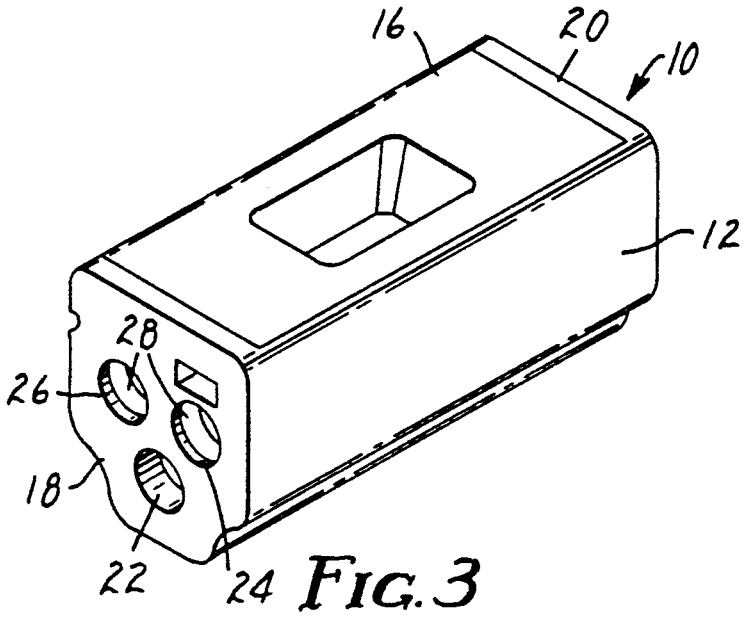
FIG.3

STACKED IN-LINE INSULATION DISPLACEMENT CONNECTOR

BACKGROUND OF THE INVENTION

1. Field of the Invention

The present invention generally relates to electrical connectors, and more particularly to an insulation displacement connector used to interconnect a variable number of electrical wires in a stacked arrangement and encapsulate the splice connection.

2. Description of the Prior Art

Insulation displacement connectors (also known as solderless electrical connectors) are known in the art, and are used to interconnect conductors which have an outer insulating layer. These devices typically include a central body or housing having one or more channels therein for receiving the conductors, and a U-shaped metallic contact element which provides the electrical connection between the conductors. As the U-element is lowered over the insulated conductor, the inner walls of the U-element penetrate the outer insulating layer (hence the term "insulation displacement"), and make contact with the central metal wire.

An early version of such an insulation displacement connector (IDC) is shown in U.S. Pat. No. 3,202,957 issued to E. Leach; that IDC has an M-shaped element, i.e., there are two parallel slots in the element for receiving the two wires to be interconnected. The prior art is replete with variations on this design, including alterations in the structure of the bodies and contact elements used in insulation displacement connectors. One of the most common designs uses a hollow body and a cap which is lowered into the body, the cap urging the metallic contact element over the wires. Another common design provides a cover attached to the hollow body by means of a "living" hinge. Both of these designs are illustrated in U.S. Pat. No. 4,954,098 issued to Hollingsworth et al.

Each of the prior art connectors, however, suffers from certain disadvantages. For example, while many of these connectors are designed for only one wire pair, others allow interconnection of a multiplicity of wires. Such multi-wire connectors provide a linear arrangement of entrances to the channels which receive the wires; in other words, the wires entering the IDC must all be generally parallel and coplanar. See, e.g., U.S. Pat. No. 4,435,034 issued to Aujla et al. This results in a flattened, elongated connector body which is often too bulky for applications where the size or shape of the connector is crucial.

Moreover, all insulation displacement connectors are designed for a specific number of wires, i.e., problems arise if the user wants to interconnect a smaller number of wires than the maximum number accommodated by the IDC. For example, if only five wires are attached to a six-wire IDC, one entrance will be left open, allowing ingress of water and other environmental contaminants which will degrade the connection. Although the connector may be filled with a sealant material, the sealant does not totally block such an unused entrance. Thus, prior art devices do not adequately address the need for variability in the number of wires which may be inserted into a given IDC.

Finally, most of the prior art IDC's provide wire entrances on only one side of the connector. Although this is acceptable for many applications, there are times when the interconnected wires must extend in opposite directions (an "in-line" configuration); when the oppositely directed wires exit from a common side, this creates an excessive strain in the wires near the IDC since each wire must bend about 90°. It would, therefore, be desirable and advantageous to devise an insulation displacement connector for interconnecting multiple wires which is more compact than prior art connectors, and which may accommodate a variable number of wires. The connector should preferably be an "in-line" IDC, i.e., one which provides connection between two or more wires which are essentially parallel and collinear.

SUMMARY OF THE INVENTION

The foregoing objective is achieved in an insulation displacement connector comprising an electrically insulative body and an electrically conductive contact element, the body having at least three entrances or holes for receiving the wires to be connected, and the holes being arranged in a staggered or stacked manner. For example, in a connector with three and only three holes, the holes are arranged in a triangular fashion. The contact element includes a plurality of U-shaped slots, these slots being staggered at different levels and spaced locations in order to make contact with the stacked wires. More than one contact element may be employed for specialized wire connections. In order to achieve the in-line effect, the body preferably has front and rear, generally parallel, walls, each of the walls having at least three entrances. This embodiment accommodates the interconnection of up to six wires.

In the in-line embodiment of the present invention, only two of the six holes are readily utilized. Each of the remaining holes is obstructed by a frangible or rupturable dam or membrane. In this manner, if it is necessary to connect only two wires, the remaining holes are sealed by the rupturable membranes, providing improved protection against environmental influences. Sealant material placed within the body provides additional protection. The cover for the body includes a piston or plunger which forces the sealant into the cracks and interstices of the body and around the wire junctions. The cover also advantageously includes a plurality of fingers which provide strain relief. The cover is preferably connected to the body by a living hinge, although it may comprise a separate member in the nature of a cap.

BRIEF DESCRIPTION OF THE DRAWINGS

The novel features and scope of the invention are set forth in the appended claims. The invention itself, however, will best be understood by reference to the accompanying drawings, wherein:

FIG. 1 is a perspective view of the stacked, in-line insulation displacement connector of the present invention depicting the cover open and showing the contact element removed;

FIG. 3 is a perspective view of the connector of FIG. 1 shown with the cover closed.

DESCRIPTION OF THE PREFERRED EMBODIMENT

Figure 2:
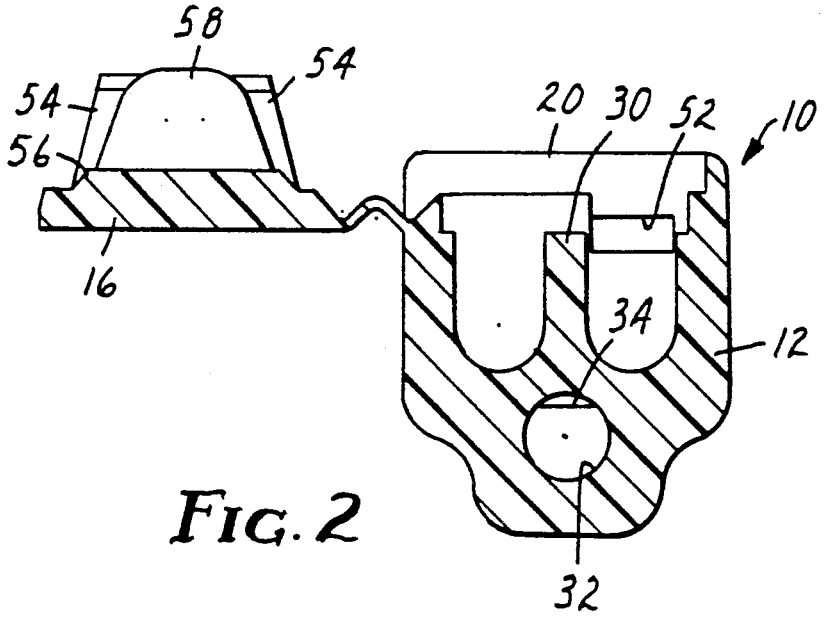
FIG. 2 is a cross-section taken along lines 2—2 of FIG. 1, through one of the interior partitions of the connector.

With reference now to the figures, and in particular with reference to FIG. 1, there is depicted the stacked, in-line insulation displacement connector 10 of the present invention. Connector 10 is generally comprised of a hollow body 12 having an open side, a contact element 14 and a cover 16. Body 12 is constructed of any electrically insulative material, preferably a hard, durable polymer such as high temperature polyester (PET) which is injection molded. In the disclosed embodiment, body 12 has a front wall 18 and a rear wall 20. The terms "front" and "rear" (as well as the terms "upper" and "lower" as used below) are not meant to be construed in a limiting sense, but rather are used for convenience when referring to the drawings.

Front wall 18 has at least three wire entrances or holes 22, 24 and 26 which are arranged in a staggered or stacked manner, i.e., they are not collinear. By stacking the holes, and thus insuring stacking of the wires to be connected, body 12 achieves a compactness which is superior to prior art connectors in both size and shape. Of course, connector 10 need not be limited to any particular size, and its dimensions will be dependent upon the size of the wires to be connected. For example, if holes 22, 24 and 26 were to have an approximate diameter of 3 mm, they could accommodate wire sizes in the range of 16–20 AWG. Body 12 would have a corresponding length of about 30 mm, while front and rear walls 18 and 10 would have a width and height of about 11 mm and 12 mm, respectively.

Rear wall 20 has three holes therein (not visible in the drawings) arranged essentially identically to holes 22, 24 and 26 in front wall 18, thus providing a total of six wire entrances. Four of these holes, however, are obstructed by a rupturable membrane; in the preferred embodiment, holes 24 and 26 are provided with such a membrane 28, as are the upper two holes in rear wall 20. In the event that fewer than six wires are to be interconnected, membranes 28 insure that the unused holes will be sealed against potentially harmful environmental influences, such as moisture penetration. Membranes 28 may be formed by a variety of methods; the simplest of these is to use an appropriate mold for the injection molding of body 12 which leaves a thin wall of the same polymer material attached along the inner wall of the holes.

With further reference to FIG. 2, it can be seen that the interior of body 12 has three channels for receiving the wires. The channels are defined by one or more partitions 30 which are formed integrally with body 12. Partitions 30 have an opening 32 therein defining the channels for wires entering through hole 22 or the corresponding lower hole in rear wall 20. A centrally located barrier 34 (also seen in FIG. 4) divides the lower channel into two sections to insure that the two wires disposed in the lower channel will be properly inserted. Body 12 may be constructed without barrier 34 if the user desires to place a single run wire through the entire lower channel, i.e., entering through hole 22 and exiting through the lower hole in rear wall 20. Partitions 30 are spaced slightly from front and rear walls 18 and 20 to provide a transverse groove for receiving the U-slots in contact element 14.

After the Wires have been inserted in body 12, they are electrically interconnected by means of contact element 14. Contact element 14 may be constructed of any electrically conductive material, preferably a rigid metal. There are six separate open-ended U-shaped slots in contact element 14 corresponding to the maximum six wires which the depicted connector 10 accommodates. In the preferred embodiment, contact element 14 includes two shoulders 36 and 38 each defining end plates having two U-slots for contacting the upper wires, and two legs 40 and 42 each having one slot for contacting the lower wires. Legs 40 and 42 accordingly extend downwardly below shoulders 36 and 38. Two support members 44 unite the shoulders and legs. In the disclosed embodiment, the shoulders, legs and support members are integrally formed by die stamping and folding a strip of a copper alloy material, the strip being about 42 mm long, 9 mm wide, and 0.5 mm thick. This construction will result in a common electrical connection between all of the wires inserted into connector 10. Those skilled in the art will appreciate, however, that separate connections between different wire pairs in a single connector 10 may be achieved by the use of two or more contact elements which are electrically isolated from one another.

It is preferable to place contact element 14 just slightly inside of body 12 prior to insertion of the wires, with shoulders 36 and 38 and legs 40 and 42 nestled inside the transverse grooves lying between partitions 30 and front and rear walls 18 and 20. Connector 10 may be prepared and packaged in this manner at the factory. This prevents the upper wires from passing too far into body 12 since they are obstructed by legs 40 and 42. Thus, a barrier such as barrier 34 is not necessary to help position the upper wires. Contact element 14 may be pushed into body 12 manually or with the aid of a crimping tool; as it enters body 12, contact element 14 makes contact with each of the wires via the U-slots. As with prior art insulation displacement connectors, the inner walls of the U-slots cut away the outer insulating layer of the wires and resiliently grip the central metal conductor. A sealing compound, such as silicone grease, should also be placed within body 12 prior to closing cover 16. The sealant may be injected just prior to use or pre-installed at the factory.

Cover 16 includes several features which enhance the effectiveness of connector 10. First of all, latching means such as clips 50 may be used to secure cover 16 to body 12. Clips 50 engage slots 52 in body 12. Secondly, four fingers 54 are positioned to contact the wires just inside body 12, providing strain relief in a manner similar to that shown in U.S. Pat. No. 4,444,449 issued to Aysta et al. Two bumps or bosses 56 are further provided on the inside surface of cover 16 which contact the upper portion of shoulders 36 and 38; these insure that the U-slots of contact element 14 will remain continually engaged with the wires. Finally, cover 16 is provided with a piston or plunger 58 which serves to force the sealant material throughout body 12; plunger 58 also makes forcible contact with support members 44 which further assists engagement of the U-slots with the wires.

With these features, the simple act of closing cover 16 disperses sealant throughout the inside of connector 10, and provides strain relief to all inserted wires in one step. As best seen in FIG. 2, cover 16 is preferably connected to body 12 by a "living" hinge, and thus is constructed of the same material as body 12. Of course, cover 16 may be physically separate from body 12, e.g., it could take the form of a cap which fits partially within body 12. FIG. 3 illustrates connector 10 With cover 16 secured over body 12.

The foregoing construction results in a connector which is both compact and provides an in-line connection; such a connector is particularly suited for wiring vehicles where the wiring runs along narrow channels within the frame of the vehicle. Of course, the stacked feature could still be advantageously used without providing the in-line design. For example, a three-wire connector could be constructed by providing only one wall of body 12 with holes; such a connector would be half the size of connector 10 (and would utilize only one-half of contact element 14). Similarly, the use of a rupturable membrane would be desirable even if the wire entrances were not stacked; however, the combination of the stacked holes, rupturable membranes and in-line design provides a clearly superior insulation displacement connector.

Figure 4:
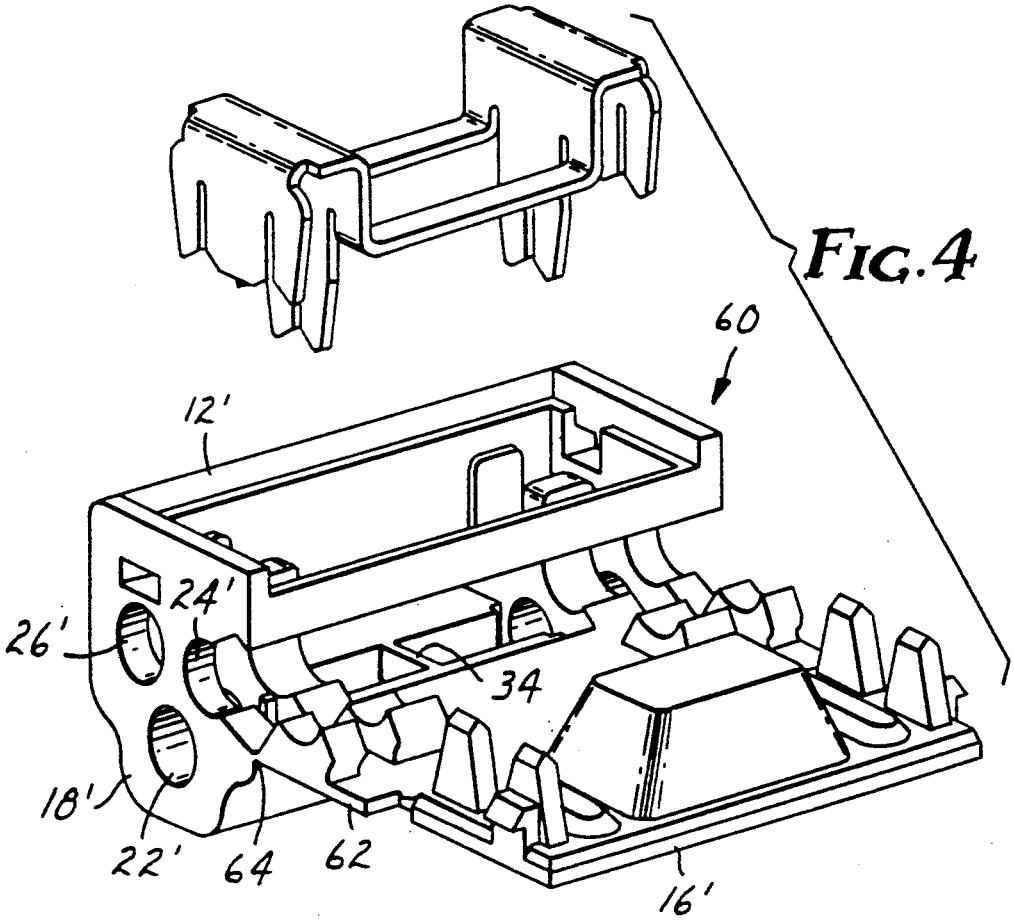
FIG. 4 is a perspective view of the tap connector embodiment of the present invention for use with an existing run wire.

Referring now to FIG. 4, a tap connector embodiment 60 of the present invention is depicted, which allows connection of up to four wires to an existing run wire. Tap connector 60 is essentially identical to connector 10 except that a sidewall 62 of tap connector 60 is connected to body 12' by means of another living hinge 64. The hole 24', which is contiguous with hinge 64, receives the laterally inserted run wire. Cover 16' is attached to sidewall 64, although the cover could be attached to the other side of body 12'. Tap connector 60 could be further modified to allow interconnection of two run wires by providing a break in front wall 18' between holes 24' and 26', in a manner similar to that shown in U.S. Pat. No. 3,912,356 issued to R. Johansson (see FIG. 4 of that patent).

Although the invention has been described with reference to specific embodiments, this description is not meant to be construed in a limiting sense. Various modifications of the disclosed embodiment, as well as alternative embodiments of the invention, will become apparent to persons skilled in the art upon reference to the description of the invention. For example, the stacked feature described herein could be utilized to create an 8-wire connector, i.e., one having four holes on opposing walls, the four holes being stacked or offset in a diamond or rhombus configuration; the contact element for such a connector would have a second pair of legs which extend beyond the shoulders of the contact element. It is therefore contemplated that the appended claims will cover such modifications that fall within the true scope of the invention.

I claim:

1. An article for interconnecting a plurality of wires, comprising:

an electrically insulative body having an open side, a rear wall and a front wall, said front wall having at least three holes and said rear wall having at least three holes, at least one of said holes in said front wall having a rupturable membrane, and at least one of said holes in said rear wall having a rupturable membrane, and said holes in said front and rear walls being in a stacked, nonlinear arrangement;

insulation displacement means located within said body for providing an electrical connection between wires which may be inserted through said holes in said front wall, and between wires which may be inserted through said holes in said rear wall; and means for covering said open side of said body.

2. A stacked, in-line insulation displacement connector comprising:

an electrically insulative, hollow body having an open side and front and rear, generally parallel walls, said front wall having at least three holes in a stacked nonlinear arrangement, and said rear wall having at least three holes in a stacked nonlinear arrangement, all but two of said holes being obstructed by rupturable membranes which provide a sealing effect at said obstructed holes;

a contact element formed by die stamping and folding a strip of metal, said contact element having:

a first, essentially planar shoulder having two generally parallel, wire-receiving slots therein, said first shoulder disposed proximate said front wall of said body, a second shoulder essentially identical to said first shoulder and generally parallel thereto, said second shoulder disposed proximate said rear wall of said body, a first, essentially planar leg having one slot therein which is generally parallel to said slots in said shoulders, said first leg attached and generally parallel to said first shoulder, proximate said front wall of said body, and said first leg being longer than said first shoulder whereby said slot in said leg may receive a wire which is in stacked relationship with respect to wires received by said slots in said first shoulder, a second leg essentially identical to said first leg, attached and generally parallel to said second shoulder, proximate said rear wall of said body, and said second leg being longer than said second shoulder whereby said slot in said second leg may receive a wire which is in stacked relationship with respect to wires received by said slots in said second shoulder, and a support member connecting said first shoulder and said first leg to said second shoulder and said second leg; a sealant material located within said body; and an electrically insulative cover member attached to said body adjacent said open side, said cover member having an inside surface and further having:

a plunger member attached to and integral with said inside surface of said cover member for forcing said sealant throughout said body, a plurality of finger members attached to and integral with said inside surface of said cover member, for relieving strain on wires inserted through said holes, and means for securely latching said cover member to said body.

3. The insulation displacement connector of claim 2 wherein said body includes a sidewall hingedly attached to said body, and said sidewall, when in a closed position, defines a portion of one of said holes in said front wall and a portion of one of said holes in said rear wall whereby a run wire may be laterally inserted into said body.

4. An insulation displacement contact element for use in making an electrical connection between a plurality of wires within an electrical connector, comprising:

a support member having first and second ends;

a first end plate having two generally parallel slots, said first end plate being attached to said first end of said support member by means of an integral first shoulder;

a second end plate having two generally parallel slots, said second end plate being attached to said second end of said support member by means of an integral second shoulder;

a first leg having one slot therein which is generally parallel to said slots in said first end plate, said first leg being attached to and integral with said first shoulder, and formed by stamping out said first leg from said support member and folding said first leg generally perpendicular to said support member, said first leg further being interposed between said first end plate and said support member whereby it obstructs any wires which may be inserted into said slots of said first end plate;

a second leg having one slot therein which is generally parallel to said slots in said second end plate, said second leg being attached to and integral with said second shoulder, and formed by stamping out said second leg from said support member and folding said second leg generally perpendicular to said support member, said second leg further being interposed between said second end plate and said support member whereby it obstructs any wires which may be inserted into said slots of said second end plate; an d said support member, first and second end plates, first and second shoulders and first and second legs all being formed from a single metallic strip.

* * * * *